United States Patent [19]

Hurdle, Jr.

[11] Patent Number: 4,922,780

[45] Date of Patent: May 8, 1990

[54] SAWMILL EDGER

[76] Inventor: Ennis J. Hurdle, Jr., Hwy. 57 East, Moscow, Tenn. 38057

[21] Appl. No.: 353,166

[22] Filed: May 11, 1989

Related U.S. Application Data

[63] Continuation of Ser. No. 55,995, Jun. 1, 1987, abandoned.

[51] Int. Cl.[5] ..... B27B 5/34

[52] U.S. Cl. ..... 83/508.3; 83/102.1; 83/425.4

[58] Field of Search ..... 83/102.1, 508.1–508.3, 83/425.3, 425.4, 433, 491, 608, 504

[56] References Cited

U.S. PATENT DOCUMENTS

| | | | |
|---|---|---|---|
| 1,461,919 | 7/1923 | La Malta | 83/508.1 |
| 2,961,015 | 11/1960 | Randall | 83/508.3 |
| 3,202,189 | 8/1965 | Pearson | 83/169 |
| 3,630,244 | 12/1971 | Cromeens | 83/508.2 |
| 3,742,796 | 7/1973 | McMillan | 83/508.3 |
| 4,414,875 | 11/1983 | Pearson | 83/508.3 |
| 4,599,929 | 7/1986 | Dutina | 83/102.1 |

*Primary Examiner*—Hien H. Phan

*Attorney, Agent, or Firm*—Walker & McKenzie

[57] ABSTRACT

A sawmill edger for making a plurality of parallel substantially horizontal cuts in a log. The edger includes a plurality of cutting blades; a drive assembly coupled to the cutting blades for rotatably driving the cutting blades; and an adjustable support assembly coupled to the cutting blades for supporting the cutting blades and for allowing the position of the cutting blades to be varied. The drive assembly includes a drive shaft with at least one of the cutting blades fixedly and nonslidably attached thereto for preventing wear between the respective cutting blade and the drive shaft when the position of said cutting blades is varied.

3 Claims, 5 Drawing Sheets

SAWMILL EDGER

This is a continuation of my application, Ser. No. 07/055,995 filed June 1, 1987, entitled "Sawmill Edger" and which is now abandoned.

BACKGROUND OF THE INVENTION

1. Field of the Invention

The present invention relates, in general, to means for edging logs and more specifically to sawmill edgers.

2. Description of the Related Art

A preliminary patentability search in class 143, subclass 370, and class 83, subclass 508.3 disclosed the following patents: Hayes, et al U.S. Pat. No. 36,150; Morris, U.S. Pat. No. 3,534,789; Shepard. U.S. Pat. No. 4,015,648: and Tannerstal, U.S. Pat. No. 4,301,844. The inventor of the present invention is also aware of a prior art edger in which a plurality of saw blades are slidably mounted on a drive shaft and movable along the length of the drive shaft by pistons and the like. None of the above patents or devices disclose or suggest the present invention.

SUMMARY OF THE INVENTION

The present invention is directed toward providing an improved sawmill edger. The present invention comprises, in general, a sawmill edger for making parallel cuts in a log, the edger including a plurality of cutting blades; drive means coupled to the cutting blades for rotatably driving the cutting blades; and adjustable support means coupled to the cutting blades for supporting the cutting blades and for allowing the distance between the parallel cuts to be varied. The drive means includes drive shaft means with at least one of the cutting blades fixedly and nonslidably attached thereto for preventing wear between the at least one of the cutting blades and the drive shaft means when the position of the cutting blades is varied.

One object of the present invention is to provide a sawmill edger which gives the operator of the sawmill enhanced visibility of the cutting blades and related structure from within the control cab of the sawmill.

DESCRIPTION OF THE PREFERRED EMBODIMENT

Figure 1:
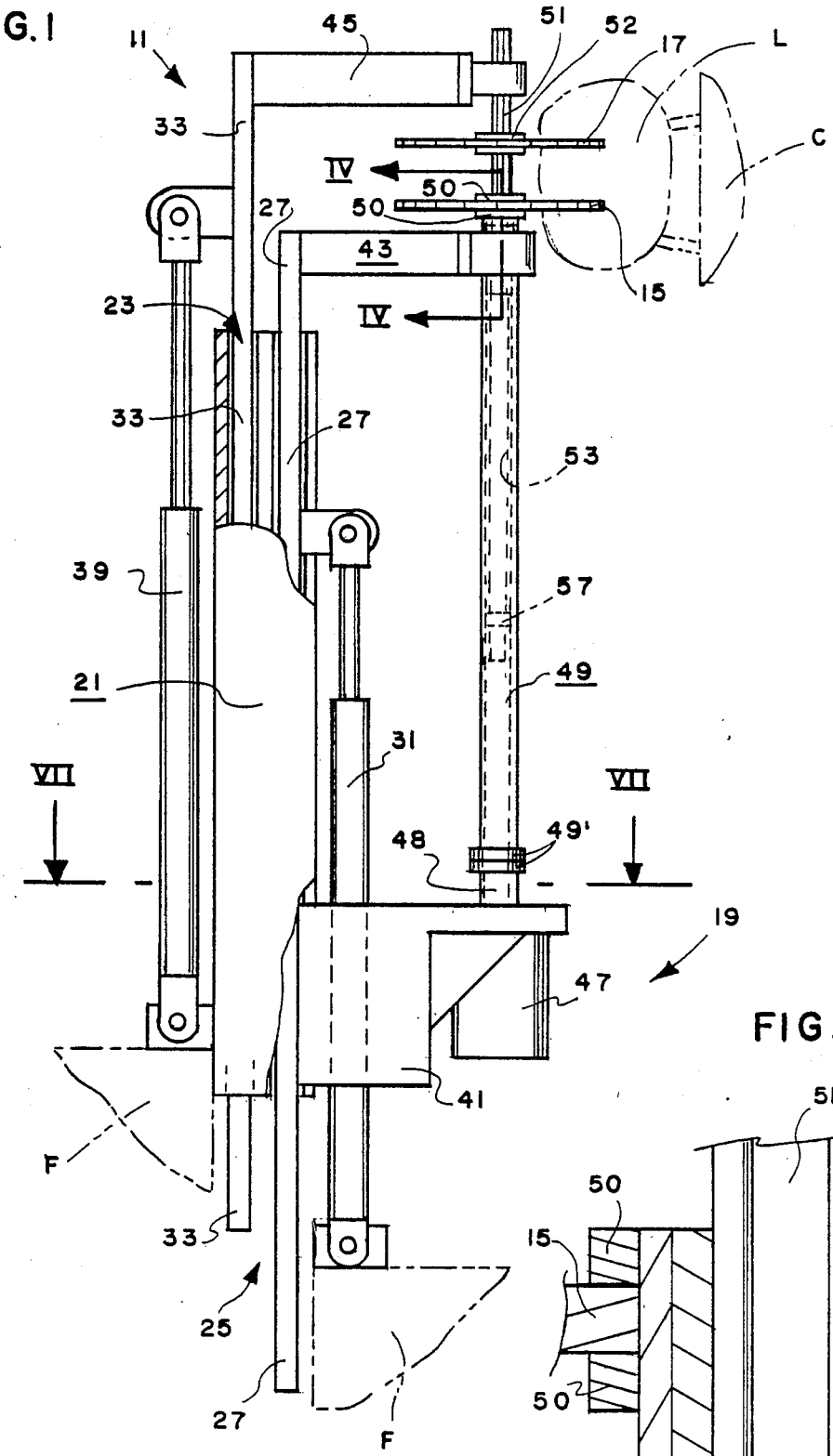
FIG. 1 is a side elevational view of a first embodiment of the edger of the present invention with portions thereof broken away for clarity and with a log and portions of a sawmill shown in broken lines.
Figure 4:
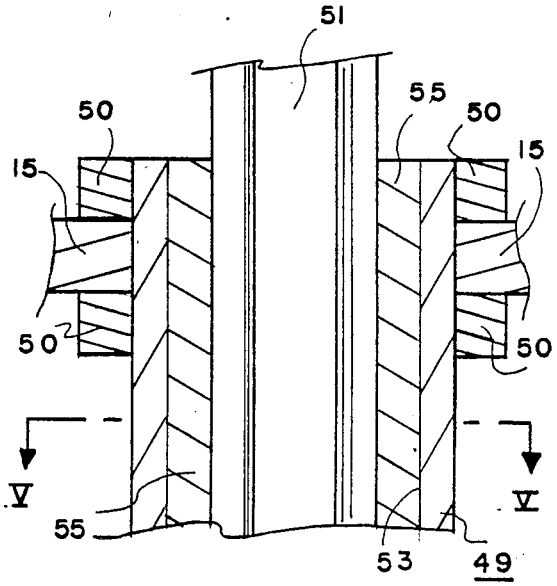
FIG. 4 is an enlarged sectional view of a portion of the edger of FIG. 1.
Figure 2:
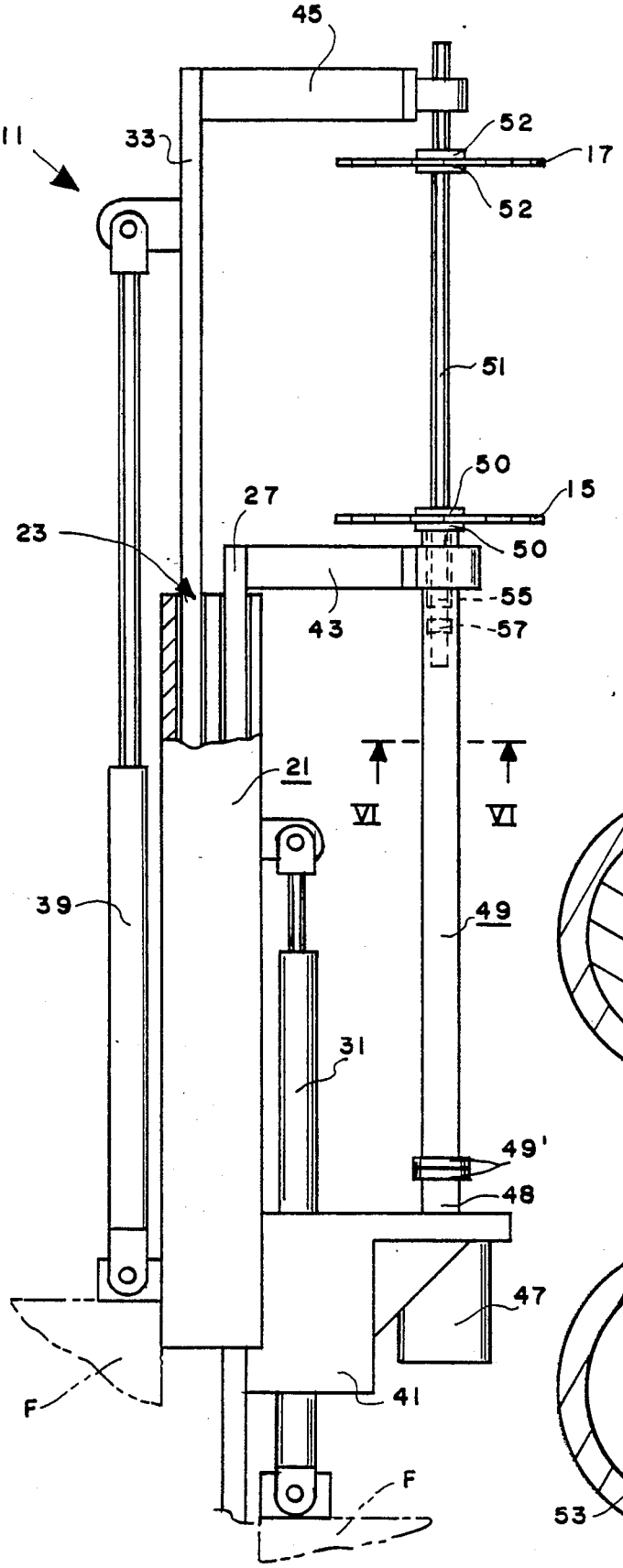
FIG. 2 is a side elevational view of the first embodiment of the edger of the present invention similar to FIG. 1 but with the cutting blades and related structure shown in a moved position.
Figure 5:
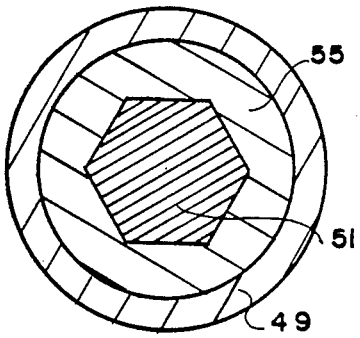
FIG. 5 is a sectional view substantially as taken on line V—V of FIG. 4.
Figure 6:
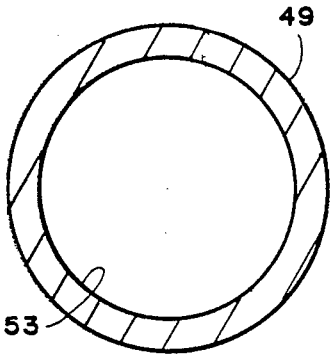
FIG. 6 is an enlarged sectional view substantially as taken on line VI—VI of FIG. 2.
Figure 3:
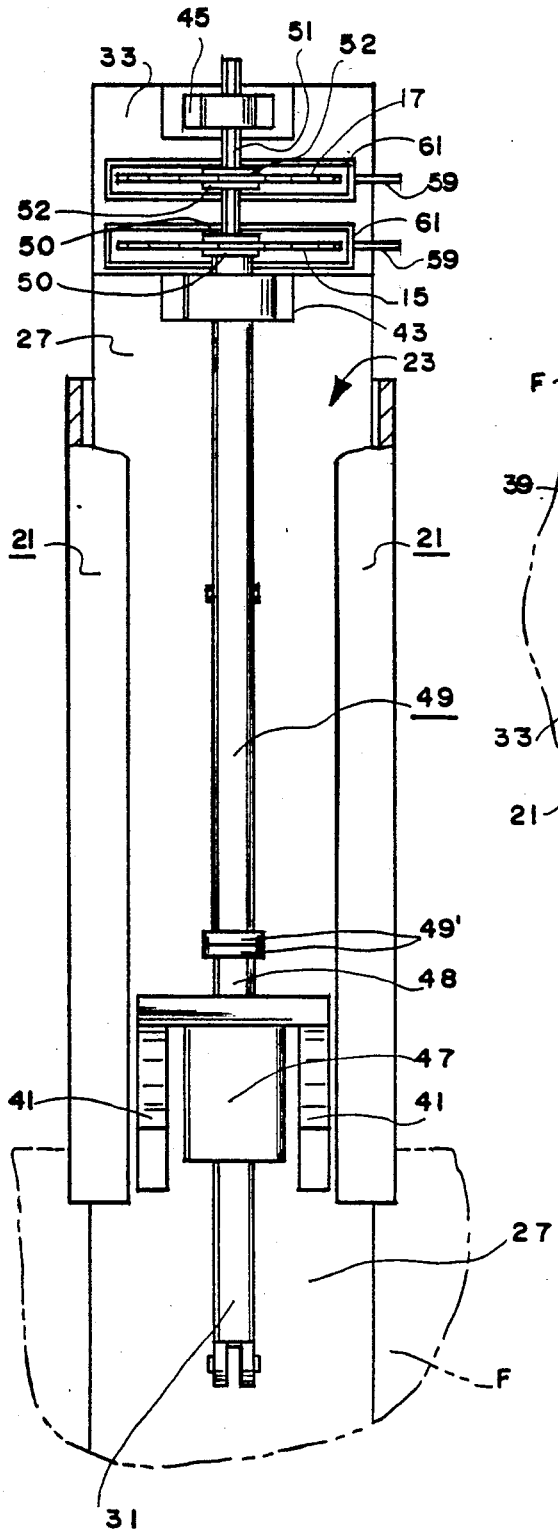
FIG. 3 is a front elevational view of FIG. 1.
Figure 7:
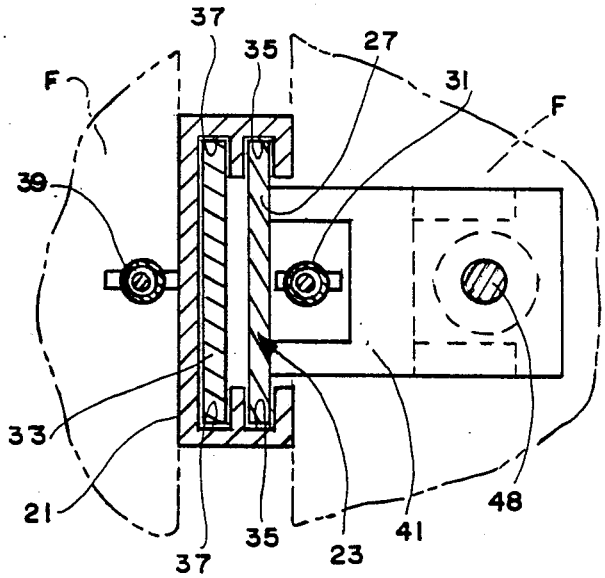
FIG. 7 is a sectional view substantially as taken on line VII—VII of FIG. 1.

The sawmill edger of the present invention preferably forms part of a modular automatic sawmill of the type well known to those skilled in the art. Such a modular automatic sawmill typically includes a frame F, cutting means such as the edger of the present invention, a carriage C for reciprocatingly moving a log L past the cutting means, and a control cab from which an operator controls the operation of the sawmill including the cutting means, etc. The control cab is typically located directly behind the cutting means to allow the operator to view the log L as it passes by the cutting means.

The sawmill edger of the present invention is for making parallel cuts in the log L, or the like, and includes, in general, a plurality of cutting blades; drive means coupled to the cutting blades for rotatably driving the cutting blades; and adjustable support means coupled to the cutting blades for supporting the cutting blades and for allowing the position of the cutting blades to be varied.

A first preferred embodiment of the edger of the present invention is shown in FIGS. 1–7 and identified by the numeral 11. The edger 11 preferably includes a horizontal first cutting blade 15; a horizontal second cutting blade 17; drive means 19 coupled to the cutting blades 15, 17 for rotatably driving the cutting blades 15, 17; and adjustable support means coupled to the cutting blades 15, 17 for supporting the cutting blades 15, 17 and for allowing the position of the cutting blades 15, 17 to be varied. The drive means includes drive shaft means with at least one of the cutting blades 15, 17 fixedly and nonslidably attached thereto for preventing wear between the respective cutting blades 15, 17 and the drive shaft means when the distance between the parallel cuts is varied.

The first and second cutting blades 15, 17 may be of any typical construction well known to those skilled in the art for edging logs and the like. Thus, each cutting blade 13, 15 may include a circular body having a plurality of teeth along the periphery thereof and having an aperture through the center thereof for attachment with the drive means 19.

The support means preferably includes an elongated body 21 having a raceway 23 therein, and preferably includes slide means 25 positioned in the raceway 23 for movement back and forth along the raceway 23. The body 21 is preferably fixedly attached to the frame F of the sawmill with the raceway 23 arranged vertically. The slide means 25 preferably includes a slide member 27 slidably mounted in the raceway 23 and motive means coupled to the slide member 27 for causing the slide member 27 to move along the raceway 23. The motive means preferably includes a piston means 31 coupled to the slide member 27 and to the frame F of the sawmill for selectively causing the slide member 27 to move up and down along the raceway 23. The slide means 25 preferably includes a second slide member 33 slidably mounted in the raceway 23 and coupled to the motive means for being moved along or within the raceway 23. Preferably, the raceway 23 includes a first raceway 35 for slidably receiving the first slide member 27 and a second raceway 37 for slidably receiving the second slide member 33 (see, in general, FIG. 7). The motive means preferably includes a second piston means 39 coupled to the second slide member 33 and to the frame F of the sawmill for selectively causing the second slide member 33 to move up and down along or within the second raceway 37.

The edger 11 preferably includes a drive mount 41 for mounting the drive means 19 to the first slide member 27, a first cutting blade mount 43 for mounting the first cutting blade 15 to the first slide member 27, and a second cutting blade mount 45 for mounting the second cutting blade 17 to the second slide member 33. The drive means 19 preferably includes a drive motor 47 fixedly attached to the first slide member 27 by way of the drive mount 41 for movement up and down along or within the first raceway 35 with the first slide member 27. The drive motor 47 has a typical rotatable drive shaft 48. The drive means 19 preferably includes a first drive shaft 49 coupled to the drive shaft 48 of the drive motor 47 by way of a typical collar 49', or the like, as will now be apparent to those skilled in the art. The first cutting blade 15 is preferably coupled to the first drive shaft 49 by a typical connector 50, or the like, for being rotated by the drive motor 47. The drive means 19 preferably includes a second drive shaft 51 coupled to the second cutting blade 17 by a typical connector 52, or the like, and slidably mounted within an aperture 53 that extends along the longitudinal axis of the first drive shaft 49. The drive shaft means of the drive means 19 is preferably defined, at least in part, by the drive shafts 48, 49, 51. The drive means 19 includes drive connection means between the first and second drive shafts 49, 51 for allowing rotational force to be transferred from the first drive shaft 49 to the second drive shaft 51 while allowing the sliding vertical movement between the first and second drive shafts 49, 51. The drive connection means may include a collar 55 fixedly mounted within the aperture 53 in the first drive shaft 49. The collar 55 may have a hexagonal aperture therethrough and the second drive shaft 51 may have a corresponding hexagonal cross section (see FIG. 5) whereby rotation of the first drive shaft 49 will cause the second drive shaft 51 to likewise rotate while the second drive shaft is allowed to slide vertically within the aperture 53 in the first drive shaft 49. A stabilizer collar 57 may be attached to the distal end of the second drive shaft 51 and located within the aperture 53 for supporting and stabilizing the distal end of the second drive shaft 51 within the aperture 53 of the first drive shaft 49 as will now be apparent to those skilled in the art.

The edger 11 preferably includes splitter means 59 associated with each of the cutting blades 15, 17 (see FIG. 3) for extending into the kerf cut into the log L by the cutting blades 15, 17. More specifically, each cutting blade 15, 17 is preferably partially covered by a typical saw guard 61 (see FIG. 3) for safety reasons as will now be apparent to those skilled in the art. The saw guards 61 are preferably mounted to the respective shaft members 49, 51 via bearings, and the like, as will now be apparent to those skilled in the art. The splitter means 59 preferably consist of a blade-like member attached to each saw guard 61 for extending into the kerf cut into the log L by the respective cutting blades 15, 17 to prevent the kerf from closing and binding the cutting blades 15, 17 and to prevent the log L from being forced out of the edger 11, etc., as will now be apparent to those skilled in the art.

The operation of the edger 11 is quite simple. To cause the cutting blades 15, 17 to rotate, the drive motor 47 is merely activated by closing a typical switch or the like (not shown). When a log L approaches the cutting blades 15, 17, the operator merely adjusts the vertical spacing of the cutting blades 15, 17 by activating the respective piston means 31, 39 by closing the typical valves, or the like, (not shown) as will now be apparent to those skilled in the art. The carriage C then conveys the log L through the edger 11 in the typical manner. It should be noted that the edger 11 may include automatic controls to cause the cutting blades 15, 17 to automatically return to a "home" position which may be a fully down position, a fully up position, or the like, as will now be apparent to those skilled in the art.

Figures 8, 9:
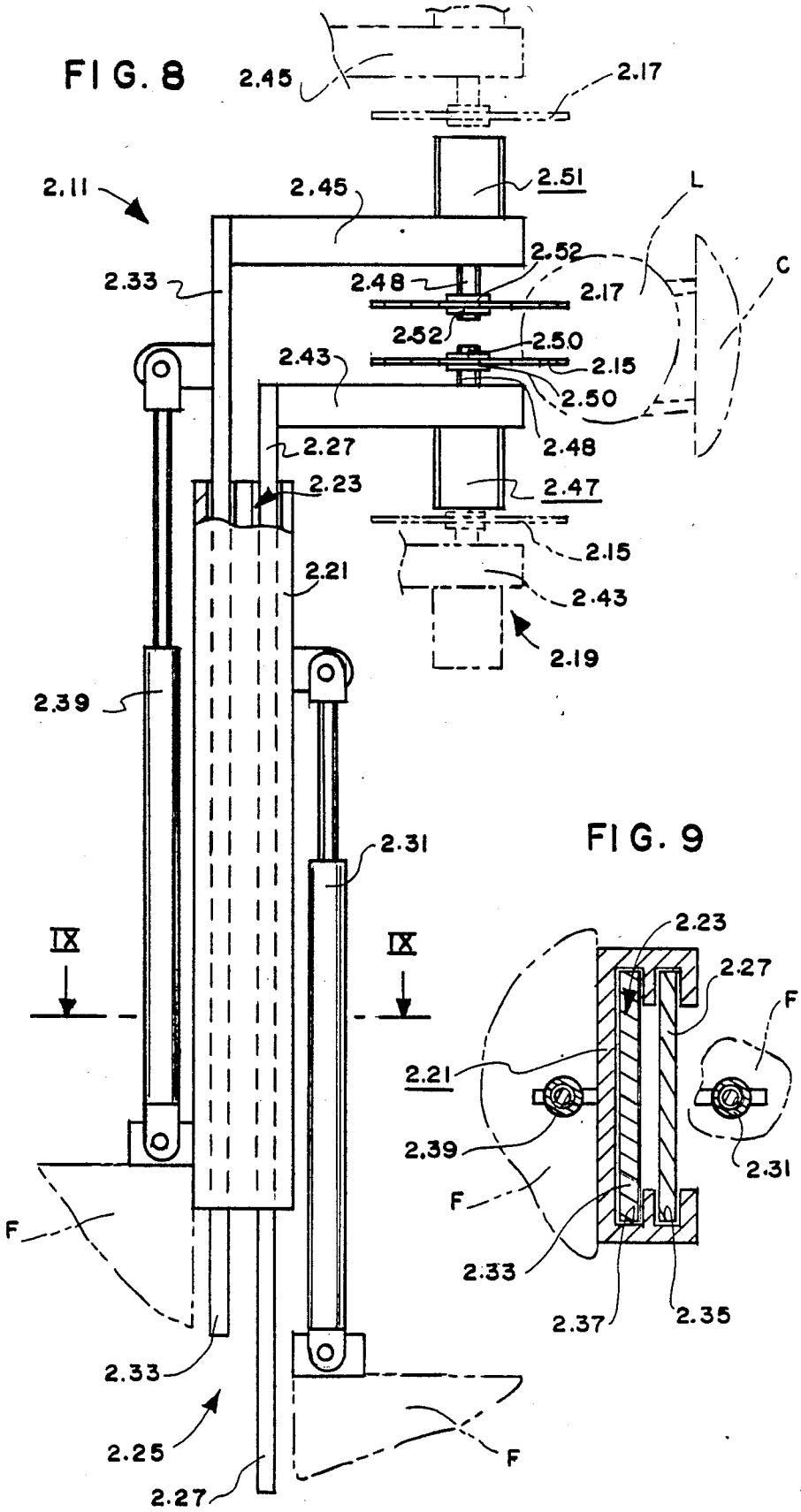
FIG. 8 is a side elevational view of a second embodiment of the edger of the present invention with a log and portions of a sawmill shown in broken lines and with the cutting blades and related structure shown in a moved position in phantom lines.
FIG. 9 is a sectional view substantially as taken on line IX—IX of FIG. 8.

A second preferred embodiment of the edger of the present invention is shown in FIGS. 8 and 9 and identified by the numeral 2.11. The edger 2.11 preferably includes a horizontal first cutting blade 2.15; a horizontal second cutting blade 2.17; drive means 2.19 coupled to the cutting blades 2.15, 2.17 for rotatably driving the cutting blades 2.15, 2.17; and adjustable support means coupled to the cutting blades 2.15, 2.17 for supporting the cutting blades 2.15, 2.17 and for allowing the distance between the cutting blades 2.15, 2.17 to be varied. The drive means includes drive shaft means with at least one of the cutting blades 2.15, 2.17 fixedly and nonslidably attached thereto for preventing wear between the respective cutting blades 2.15, 2.17 and the drive shaft means when the distance between the parallel cuts is varied.

The first and second cutting blades 2.15, 2.17 may be of any typical construction well known to those skilled in the art for edging logs and the like. Thus, each cutting blade 2.13, 2.15 may include a circular body having a plurality of teeth along the periphery thereof and having an aperture through the center thereof for attachment with the drive means 2.19.

The support means of the edger 2.11 is preferably substantially identical to the support means of the edger 11 and preferably includes an elongated body 2.21 having a raceway 2.23 therein, and slide means 2.25 positioned in the raceway 2.23 for movement back and forth along the raceway 2.23. The body 2.21 is preferably fixedly attached to the frame F of the sawmill with the raceway 2.23 arranged vertically. The slide means 2.25 preferably includes a slide member 2.27 slidably mounted in the raceway 2.23 and motive means coupled to the slide member 2.27 for causing the slide member 2.27 to move along the raceway 2.23. The motive means preferably includes a piston means 2.31 coupled to the slide member 2.27 and to the frame F of the sawmill for selectively causing the slide member 2.27 to move up and down along the raceway 2.23. The slide means 2.25 preferably includes a second slide member 2.33 slidably mounted in the raceway 2.23 and coupled to the motive means for being moved along or within the raceway 2.23. Preferably, the raceway 2.23 includes a first raceway 2.35 for slidably receiving the first slide member 2.27 and a second raceway 2.37 for slidably receiving the second slide member 2.33 (see, in general, FIG. 9). The motive means preferably includes a second piston means 2.39 coupled to the second slide member 2.33 and to the frame F of the sawmill for selectively causing the second slide member 2.33 to move up and down along or within the second raceway 2.37.

The edger 2.11 preferably includes a first cutting blade mount 2.43 for mounting the first cutting blade 2.15 to the first slide member 2.27, and a second cutting blade mount 2.45 for mounting the second cutting blade 2.17 to the second slide member 2.33. The drive means 2.19 preferably includes a first drive motor 2.47 having a drive shaft 2.48 attached directly to the first cutting blade 2.15 by a typical connector 2.50 or the like. The drive means 2.19 preferably includes a second drive motor 2.51 having a drive shaft 2.48 coupled directly to the second cutting blade 2.17 by a typical connector 2.52 or the like. The drive shaft means of the drive means 2.19 is preferably defined, at least in part, by the drive shafts 2.48.

The edger 2.11 preferably includes splitter means (not shown) associated with each of the cutting blades 2.15, 2.17 for extending into the kerf cut into the log by the cutting blades 2.15, 2.17. The splitter means of the edger 2.11 are substantially identical to the splitter means 59 of the edger 11 and need not be further described for a clear understanding by those skilled in the art.

The operation of the edger 2.11 is quite simple. To cause the cutting blades 2.15, 2.17 to rotate, the drive motors 2.47, 2.51 are merely activated by closing a typical switch or the like (not shown). When a log L approaches the cutting blades 2.15, 2.17, the operator merely adjusts the vertical spacing of the cutting blades 2.15, 2.17 by activating the respective piston means 2.31, 2.39 by closing the typical valves or the like (not shown) as will now be apparent to those skilled in the art. The carriage C then conveys the log L through the edger 2.11 in the typical manner. It should be noted that the edger 2.11 may include automatic controls to cause the cutting blades 2.15, 2.17 to automatically return to a "home" position which may be a fully down position, a fully up position, or the like, as will now be apparent to those skilled in the art.

Figure 10:
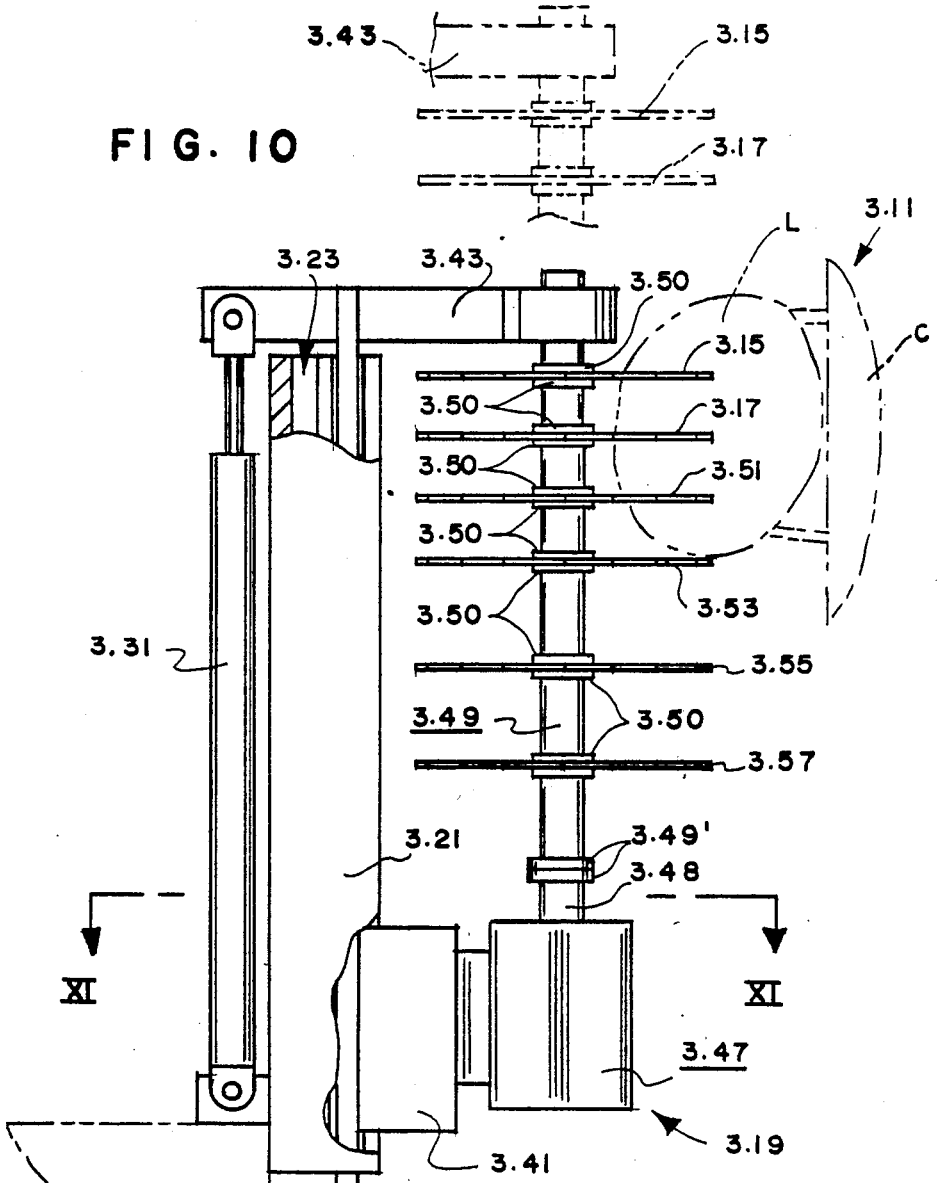
FIG. 10 is a side elevational view of a third embodiment of the edger of the present invention with a log and portions of a sawmill shown in broken lines and with the cutting blades and related structure shown in a moved position in phantom lines.
Figure 11:
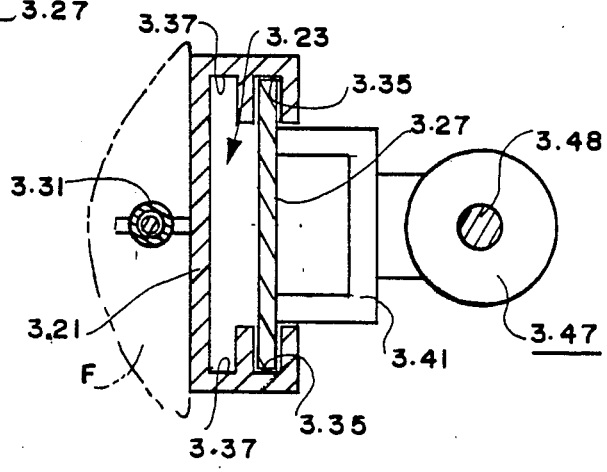
FIG. 11 is a sectional view substantially as taken on line X1—X1 of FIG. 10.

A third preferred embodiment of the edger of the present invention is shown in FIGS. 10 and 11 and identified by the numeral 3.11. The edger 3.11 preferably includes a horizontal first cutting blade 3.15; a horizontal second cutting blade 3.17; drive means 3.19 coupled to the cutting blades 3.15, 3.17 for rotatably driving the cutting blades 3.15, 3.17; and adjustable support means coupled to the cutting blades 3.15, 3.17 for supporting the cutting blades 3.15, 3.17 and for allowing the position of the cutting blades 3.15, 3.17 to be varied. The drive means includes drive shaft means with at least one of the cutting blades 3.15, 3.17 fixedly and nonslidably attached thereto for preventing wear between the respective cutting blades 3.15, 3.17 and the drive shaft means when the distance between the parallel cuts is varied.

The first and second cutting blades 3.15, 3.17 may be of any typical construction well known to those skilled in the art for edging logs and the like. Thus, each cutting blade 3.13, 3.15 may include a circular body having a plurality of teeth along the periphery thereof and having an aperture through the center thereof for attachment with the drive means 3.19.

The support means preferably includes an elongated body 3.21 having a raceway 3.23 therein, and preferably includes slide means 3.25 positioned in the raceway 3.23 for movement back and forth along the raceway 3.23. The body 3.21 is preferably fixedly attached to the frame F of the sawmill with the raceway 3.23 arranged vertically. The slide means 3.25 preferably includes a slide member 3.27 slidably mounted in the raceway 3.23 and motive means coupled to the slide member 3.27 for causing the slide member 3.27 to move along the raceway 3.23. The motive means preferably includes a piston means 3.31 coupled to the slide member 3.27 and to the frame F of the sawmill for selectively causing the slide member 3.27 to move up and down along the raceway 3.23. Preferably, the raceway 3.23 is identical to the raceway 23 of the first embodiment hereabove disclosed and includes a first raceway 3.35 for slidably receiving the slide member 3.27 and a second raceway 3.37 (see, in general, FIG. 11). However, the second raceway 3.37 is not used in the normal operation of the third embodiment and merely allows the third embodiment to be easily converted to the first or second embodiments if desired.

The edger 3.11 preferably includes a drive mount 3.41 for mounting the drive means 3.19 to the slide member 3.27, and a cutting blade mount 3.43 attached to the slide member 3.27. The drive means 3.19 preferably includes a drive motor 3.47 fixedly attached to the slide member 27 by way of the drive mount 3.41 for movement up and down along or within the first raceway 35 with the slide member 27. The drive motor 3.47 has a typical rotatable drive shaft 3.48. The drive means 3.19 preferably includes a drive shaft 3.49 coupled to the drive shaft 3.48 of the drive motor 3.47 by way of a typical collar 3.49' or the like as will now be apparent to those skilled in the art. The drive shaft means of the drive means preferably defined, at least in part, by the drive shafts 3.48, 3.49. The first and second cutting blades 3.15, 3.17 are preferably coupled to the drive shaft 3.49 by typical connectors 3.50 or the like for being rotated by the drive motor 3.47. The edger 3.11 preferably includes a third cutting blade 3.51, a fourth cutting blade 3.53, a fifth cutting blade 3.55 and a sixth cutting blade 3.57 all identical to the first and second cutting blades 3.15, 3.17 and all preferably coupled to the drive shaft 3.49 by typical connectors 3.50 or the like for being rotated by the drive motor 3.47. The various cutting blades 3.15, 3.17, 3.51, 3.53, 3.55, 3.57 are preferably fixedly attached to the drive shaft 3.49 with the distances between one another varying. Thus, for example, the first, second, third and fourth cutting blades 3.15, 3.17, 3.51, 3.53 may be vertically spaced from one another 4 inches while fourth, fifth and sixth cutting blades 3.53, 3.55, 3.57 may be vertically spaced from one another 6 inches.

The edger 3.11 preferably includes splitter means (not shown) associated with each of the cutting blades 3.15, 3.17, 3.51, 3.53, 3.55, 3.57 for extending into the kerf cut into the log by the cutting blades 3.15. 3.17. 3.51. 3.53, 3.55, 3.57. The splitter means of the edger 3.11 are substantially identical to the splitter means 59 of the edger 11 and need not be further described for a clear understanding by those skilled in the art.

The operation of the edger 3.11 is quite simple. To cause the cutting blades 3.15, 3.17, 3.51, 3.53, 3.55, 3.57 to rotate, the drive motor 3.47 is merely activated by closing a typical switch or the like (not shown). When a log L approaches the cutting blades 3.15, 3.17, 3.51, 3.53, 3.55, 3.57 the operator merely adjusts the vertical position of the cutting blades 3.15, 3.17, 3.51, 3.53, 3.55, 3.57 by activating the piston means 3.31 by closing the typical valves, or the like, (not shown) as will now be apparent to those skilled in the art. The carriage C then conveys the log L through the edger 3.11 in the typical manner. It should be noted that the edger 3.11 may include automatic controls to cause the cutting blades 3.15, 3.17, 3.51, 3.53, 3.55, 3.57 to automatically return to a "home" position which may be a fully down position, a fully up position, or the like, as will now be apparent to those skilled in the art.

The specific construction of the edger of the present invention may vary as will now be apparent to those skilled in the art. Thus, for example, the raceway means and slide members may be machined out of metal in any manner now apparent to those skilled in the art and the various cutting blades, motors, pistons and the like may consist of "off-the-shelf" items as will now be apparent to those skilled in the art. Also, it will be understood that while the various cutting blades are shown in the drawings as typical saw blades, typical chipping heads may also be used as will now be apparent to those skilled in the art. Thus, when the words "cutting blades" are used herein they should be deemed to include the both saw blades and chipping heads.

Although the present invention has been described and illustrated with respect to a preferred embodiment and a preferred use therefor, it is not to be so limited since modifications and changes can be made therein which are within the full intended scope of the invention.

I claim:

1. A sawmill edger for making parallel cuts in a log, said edger comprising:

(a) a plurality of cutting blades;

(b) drive means coupled to said cutting blades for rotatably driving said cutting blades; and (c) adjustable support means coupled to said cutting blades for supporting said cutting blades and for allowing the position of said cutting blades to be varied; said drive means including drive shaft means with at least one of said cutting blades fixedly attached thereto in a nonslidable manner with respect to said drive shaft means for preventing wear between said at least one of said cutting blades and said drive shaft means when the position of said cutting blades is varied; said drive means including motor means coupled to said drive shaft means for rotatably driving said drive shaft means; said support means including an elongated body having an elongated raceway therein, and including slide means positioned in said raceway for movement back and forth along said raceway; said support means including piston means attached to said slide means for causing said slide means to move back and forth along said raceway; said support means including mounting means extending between said slide means and said cutting blades for mounting said cutting blades to said slide means; said raceway including an elongated first raceway and an elongated second raceway; said slide means including an elongated first slide member positioned in said first raceway and an elongated second slide positioned in said second raceway; said motor means being attached to said first slice member for movement therewith.

2. A sawmill edger for making parallel cuts in a log, said edger comprising:

(a) a plurality of cutting blades; said plurality of cutting blades includes a first cutting blade and a second cutting blade;

(b) drive means coupled to said cutting blades for rotatably driving said cutting blades; and (c) adjustable support means coupled to said cutting blades for supporting said cutting blades and for allowing the position of said cutting blades to be varied; said drive means including drive shaft means with at least one of said cutting blades fixedly attached thereto in a nonslidable manner with respect to said drive shaft for preventing wear between said at least one of said cutting blades and said drive shaft means when the position of said cutting blades is varied; said support means including an elongated body having an elongated raceway therein, and including slide means positioned in said raceway for movement back and forth along said raceway; said support means including piston means attached to said slide means for causing said slide means to move back and forth along said raceway; said support means including mounting means extending between said slide means and said cutting blades for mounting said cutting blades to said slide means; said raceway including an elongated first raceway and an elongated second raceway; said slide means including an elongated first slide member positioned in said first raceway and an elongated second slide positioned in said second raceway; said mounting means including first mount means extending between said first slide member and said first cutting blade for attaching said first cutting blade to said first slide member, and including second mount means extending between said second slide member and said second cutting blade for attaching said second cutting blade to said second slide member; said drive shaft means being coupled to said first and second cutting blades for rotatably driving said first and second cutting blades; said drive means including motor means coupled to said drive shaft means for rotatably driving said drive shaft means; said drive shaft means including a first drive shaft fixedly and nonslidably attached to said first cutting blade and includes a second drive shaft fixedly and nonslidably attached to said second cutting blade; said motor means including first motor means coupled to said first drive shaft for rotatably driving said first cutting blade, and including second motor means coupled to said second drive shaft for rotably driving said second cutting blade; said first motor means being attached to said first slide member for movement therewith, said second motor means being attached to said second slide member for movement therewith.

3. A sawmill edger for making at least an upper cut and a lower cut in a log, said upper and lower cuts being parallel to one another, said log having a reference plane parallel to and centered between said upper and lower cuts, said edger comprising:

(a) upper and lower cutting blades;

(b) drive means coupled to said cutting blades for rotatably driving said cutting blades; and (c) adjustable support means coupled to said cutting blades for supporting said cutting blades and for allowing the position of said cutting blades to be varied relative to said reference plane; said support means including an elongated body having an elongated raceway therein, and including slide means positioned in said raceway for movement back and forth along said raceway; said support means including piston means attached to said slide means for causing said slide means to move back and forth along said raceway; said support means including cutting blade mount means for mounting said cutting blades to said slide means; movement of said slide means back and forth along said raceway causing the spacing of said cuts with respect to said reference plane to be varied, said drive means including drive shaft means with at least one of said cutting blades fixedly attached thereto in a nonslidable manner with respect to said drive shaft means for preventing wear between said at least one of said cutting blades and said drive shaft means when the position of said cutting blades is varied and including motor means coupled to said drive shaft means for rotatably driving said drive shaft means, said motor means being attached to said slide means for movement therewith; said upper cutting blade being located on the opposite side of said reference plane from said lower cutting blade and said support means supporting said drive shaft means and moving said drive shaft means during adjustment.

* * * * *